United States Patent [19]

Dickinson

[11] Patent Number: 5,058,763

[45] Date of Patent: Oct. 22, 1991

[54] WASTE SEPARATION APPARATUS

[76] Inventor: Addison M. Dickinson, 22 W. Shields St., Newark, Ohio 43055

[21] Appl. No.: 612,211

[22] Filed: Nov. 9, 1990

Related U.S. Application Data

[63] Continuation-in-part of Ser. No. 515,073, Apr. 26, 1990, Pat. No. 4,974,746, which is a continuation-in-part of Ser. No. 324,578, Mar. 16, 1989, abandoned.

[51] Int. Cl.[5] ..... B65D 1/24

[52] U.S. Cl. ..... 220/404; 220/909

[58] Field of Search ..... 220/404, 909

[56] References Cited

U.S. PATENT DOCUMENTS

| | | | |
|---|---|---|---|
| 1,923,816 | 8/1933 | Firl | 83/26 |
| 2,113,153 | 4/1938 | Jonassen | 248/101 |
| 2,625,973 | 8/1951 | Weldon | 150/1 |
| 2,736,454 | 2/1956 | McConnell | 220/20 |
| 3,904,218 | 9/1975 | Kostic | 280/79.2 |
| 3,977,450 | 8/1976 | Schampier | 150/1 |
| 3,995,924 | 12/1976 | Jones | 312/211 |
| 4,585,283 | 4/1986 | Redmon | 312/250 |
| 4,589,570 | 5/1986 | Auten | 220/404 |
| 4,610,039 | 9/1986 | Stern | 4/285 |
| 4,664,347 | 5/1987 | Brown et al. | 220/908 X |
| 4,765,579 | 8/1988 | Robbins, III et al. | 220/404 X |
| 4,775,123 | 10/1988 | Borland | 248/99 |
| 4,801,034 | 1/1989 | Sandomeno | 220/23.83 |
| 4,834,260 | 5/1989 | Auten | 220/404 |
| 4,834,262 | 5/1989 | Reed | 220/404 |
| 4,867,328 | 9/1989 | McCarthy | 220/909 X |
| 4,874,111 | 10/1989 | Heller | 220/404 |
| 4,905,853 | 3/1990 | Strawder | 220/404 X |
| 4,938,380 | 7/1990 | Donahoe | 220/404 |
| 4,953,740 | 9/1990 | Koda | 220/404 X |
| 4,967,900 | 11/1990 | Gossett | 220/404 |
| 4,974,746 | 12/1990 | Dickinson | 220/404 |

FOREIGN PATENT DOCUMENTS

| | | |
|---|---|---|
| 1104627 | 7/1981 | Canada . |
| 233366A | 8/1987 | . |
| 3446100 | 6/1986 | Fed. Rep. of Germany . |
| 3600603 | 8/1986 | Fed. Rep. of Germany . |
| 2302255 | 9/1976 | France . |
| 767364 | 1/1957 | United Kingdom . |

*Primary Examiner*—Steven M. Pollard

*Attorney, Agent, or Firm*—Polster, Polster and Lucchesi

[57] ABSTRACT

A waste separation container for selectively separating and storing waste material includes a plurality of thin-walled flexible bags supported by a closure or frame engaging an upper part of the container. In embodiments that include a central partition in the container, the partition can have notches that are useful in mounting bags with handles. The container can have protrusions in the form of bollards or cleats that are also useful in mounting bags with handles.

13 Claims, 5 Drawing Sheets

Fig. 1
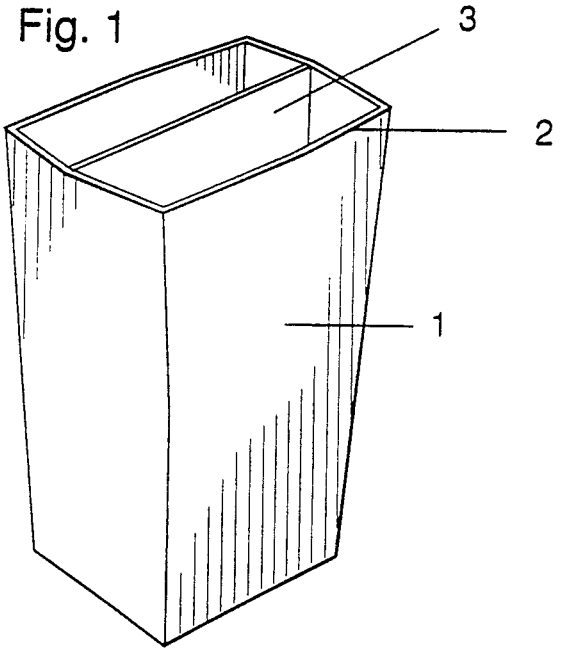
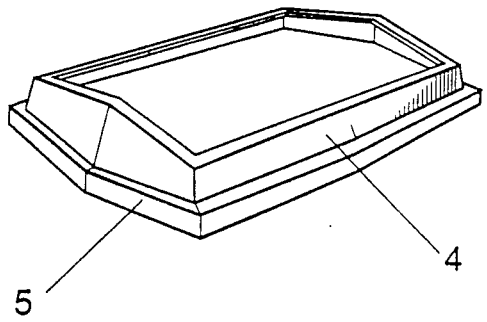
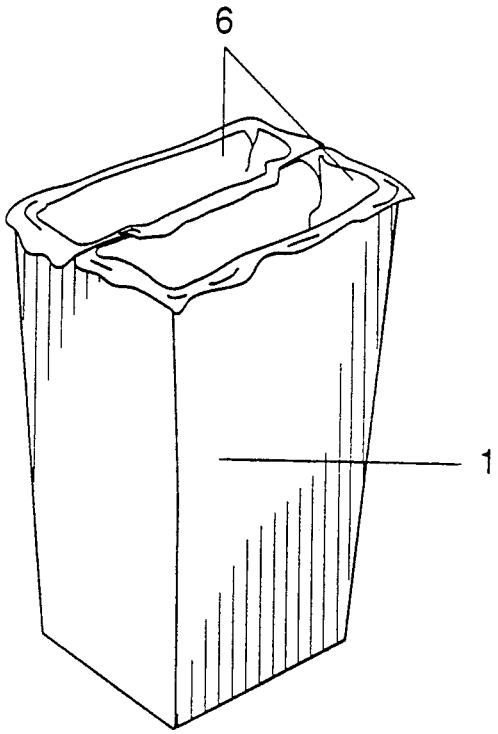
Fig. 2
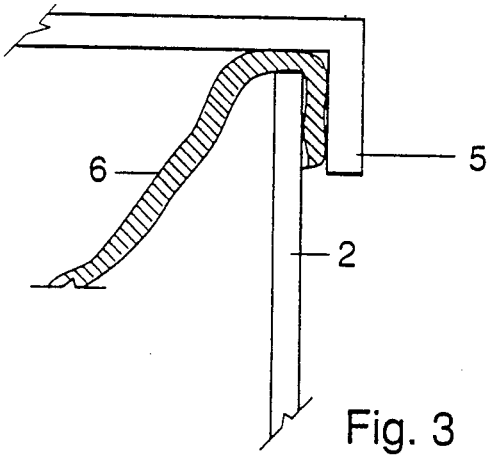
Fig. 3

WASTE SEPARATION APPARATUS

CROSS REFERENCE TO RELATED APPLICATION

This is a continuation-in-part of my co-pending application Ser. No. 515,073, filed Apr. 26, 1990, now U.S. Pat. No. 9,874,796, which was a continuation-in-part of Ser. No. 324,578, filed Mar. 16, 1989, now abandoned.

BACKGROUND OF THE INVENTION

This invention relates to waste receptacles having multiple liner bag support structures to provide the essential convenience necessary for the success of recycling insofar as separating and segregating recyclables from non-recyclables is concerned.

Devices have been proposed which include partitions and self supporting sub-containers that are often too large for indoor use as well as being difficult to handle.

Other devices have been proposed in which a plurality of angled upturned hooks at the upper ends of a container are arranged to support a plurality of plastic liner bags.

However, these devices have not been entirely satisfactory and particularly the method of connection of the plastic bags to the device has been very limited in that the upturned hooks are to puncture the bags at their upper portions which therefore causes them, when used, to rip or tear from the weight of the contents. In addition, this type of device allows only one type and size of bag to be used; as well as being difficult to operate and ineffective, they have a very limited capacity for wide spread use and acceptance.

It is one object of the present invention, therefore, to provide an improved multiple liner bags support structure which will not damage the bags, is versatile enough to allow the usage of different types and sizes of bags, and provides optimum durability and flexibility.

Waste separation apparatus having multiple liner bag support structures have been invented which are disclosed in co-pending application 515,073. The structures of the present application are modifications of those structures, in some respects more simple in construction.

SUMMARY OF THE INVENTION

In accordance with this invention, generally stated, a waste receptacle is provided in which a plurality of thin-walled flexible bags are supported to receive waste material.

In one embodiment, partitioned and non-partitioned containers are used in conjunction with inner and/or outer frictionally engaging closures or frames which optionally may include the use of an inverted U member or two integrally molded parallel members for the support of multiple liner bags. Additionally, the containers and partitions may include bag positioning protrusions and notches.

In another embodiment, a tongue and groove arrangement between a frame or closure and receptacle functions to support multiple liner bags.

In any embodiment in which a cover, lid or frame is supplied, it is contemplated that indicia, which can be in the form of words or illustrations, be applied to designate the kinds of waste to be deposited in a particular bag, or that openings of different shapes or sizes or both be provided to make reasonably certain that the appropriate waste be deposited in the bags beneath the cover, or, preferably both indicia and sized and shaped apertures be supplied, where feasible.

LIST OF REFERENCE NUMERALS

1. Receptacle
2. Upper end of receptacle
3. Partition
4. Frame
5. Shelf and lip
6. Bags without handles
7. Bags with handles
8. Bag handles
9. Receptacle
10. Partition
11. Rim
12. Inverted U-member
13. Frame with inverted U-member
14. Two parallel members
15. Frame with two parallel members
16. Partition having notches
17. Partition notches
18. Container having positioning notches
19. Notches
20. Container having positioning protrusions
21. Positioning protrusions
22. Inner frame
23. Container
24. Frame with tongue
25. Tongue
26. Groove
27. Container
28. Notches

BRIEF DESCRIPTION OF DRAWINGS

FIG. 1 is a perspective view of a partitioned receptacle.

FIG. 2 is an exploded perspective view of a partitioned container with two bags installed and a frictionally engaging frame.

FIG. 3 is a cross sectional view of a container wall and a frame with a bag portion therebetween.

DETAILED DESCRIPTION OF THE PREFERRED EMBODIMENTS

Figure 4:
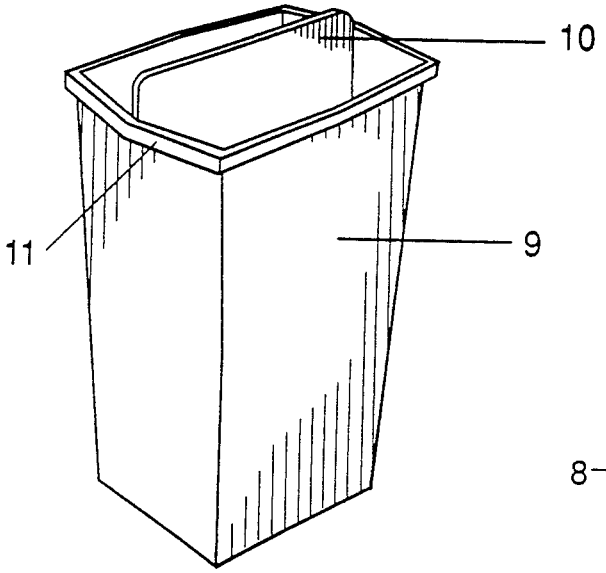
FIG. 4 is a perspective view of a partition extending above the upper rim.

FIG. 1 shows a receptacle 1 having a partition 3 with a top edge substantially flush with an upper end 2 of receptacle 1. In FIG. 2, two bags 6 are shown positioned by folding a portion of a first bag's upper end over the upper end of partition 3 and another portion over the upper end 2 of receptacle 1. The second bag 6 is positioned in a similar manner in the adjacent compartment. Final secure support is provided by a closure-frame 4 which has an inner surface of a shelf and lip 5 dimensioned to embrace the upper end 2 of receptacle 1 with the upper end portions of bags 6, sandwiched tightly therebetween as shown in FIG. 3.

Figure 5:
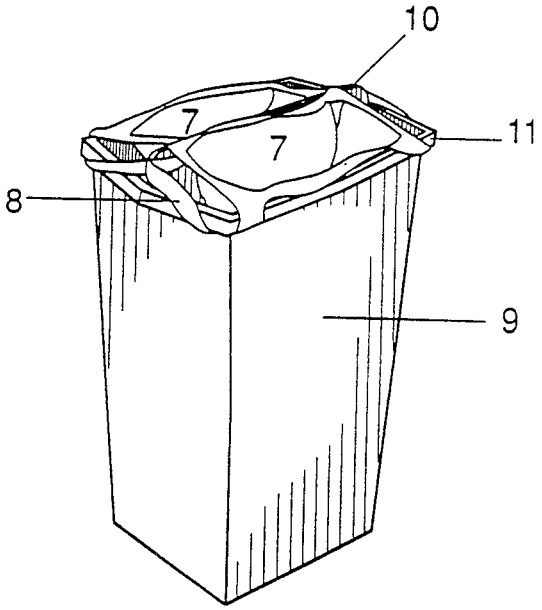
FIG. 5 is a perspective view of a partitioned container having two bags with handles installed.

FIG. 4 shows a receptacle 9 having a partition 10 with an upper part substantially extended above a rim 11 of the receptacle 9. As shown in FIG. 5, bags 7 with integral looped handles 8 can be supported by wrapping bag handles 8 around partition 10 and rim 11.

Figure 6:
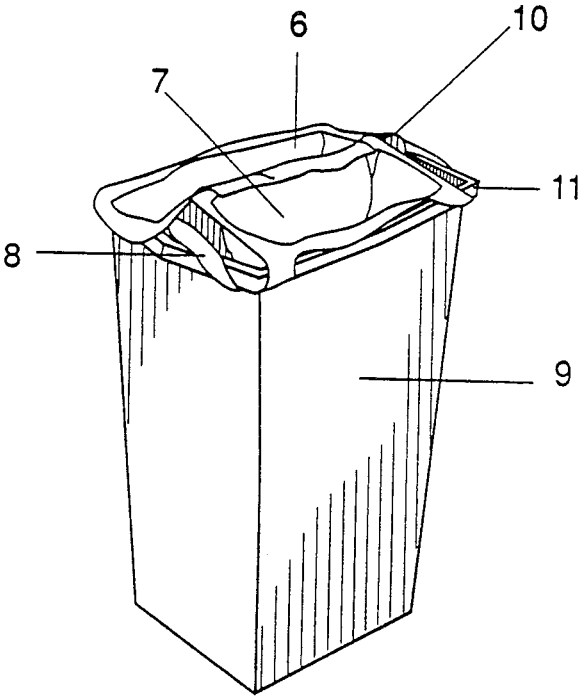
FIG. 6 is a perspective view of a partitioned container having a bag with handles and a bag without handles installed.
Figure 7:
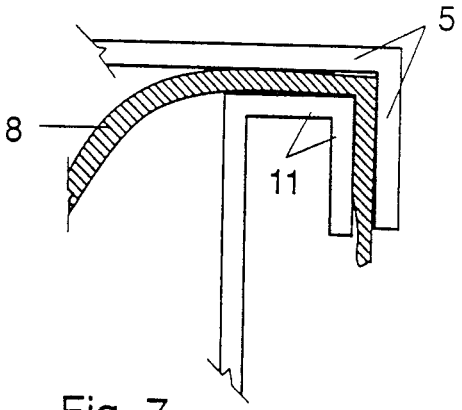
FIG. 7 is a cross sectional view of a recepticle's upper rim and a frame with a bag portion therebetween.

FIG. 6 shows how a combination of both types of bags 6 and 7 can be positioned with final secure support being provided by the sandwiching of a top area of the bags between the rim 11 and the inner surfaces of the shelf and lip 5 of frictionally engaging frame 4 as shown in the cross sectional view of FIG. 7.

Figure 8:
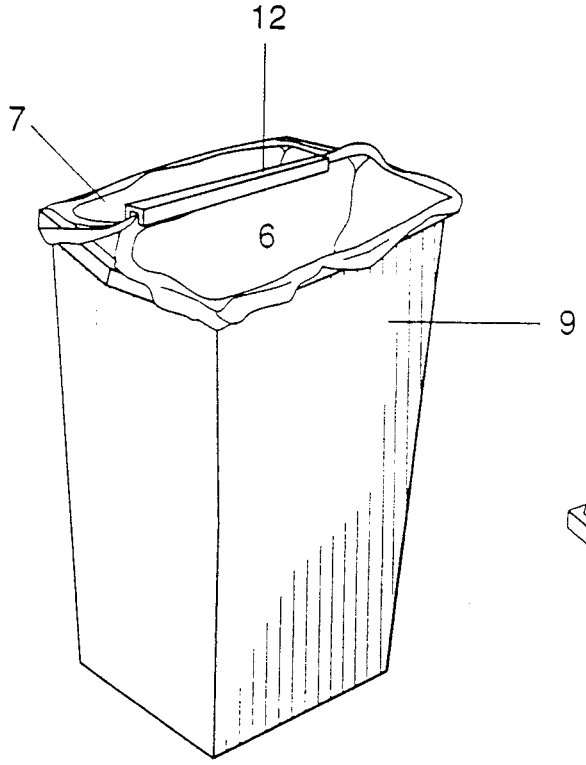
FIG. 8 is a perspective view of a partitioned container and an inverted U-member.

FIG. 8 includes a useful but optional elongated inverted U-member 12 that is dimensioned to frictionally engage partitions 3 or 10, thus supporting portions of bags 6 and 7 therebetween.

Figure 9:
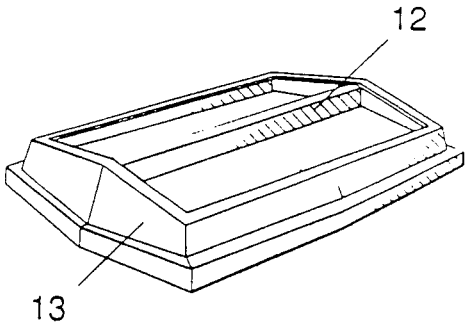
FIG. 9 is a perspective view of a frame having an integrally molded inverted U-member.
Figure 10:
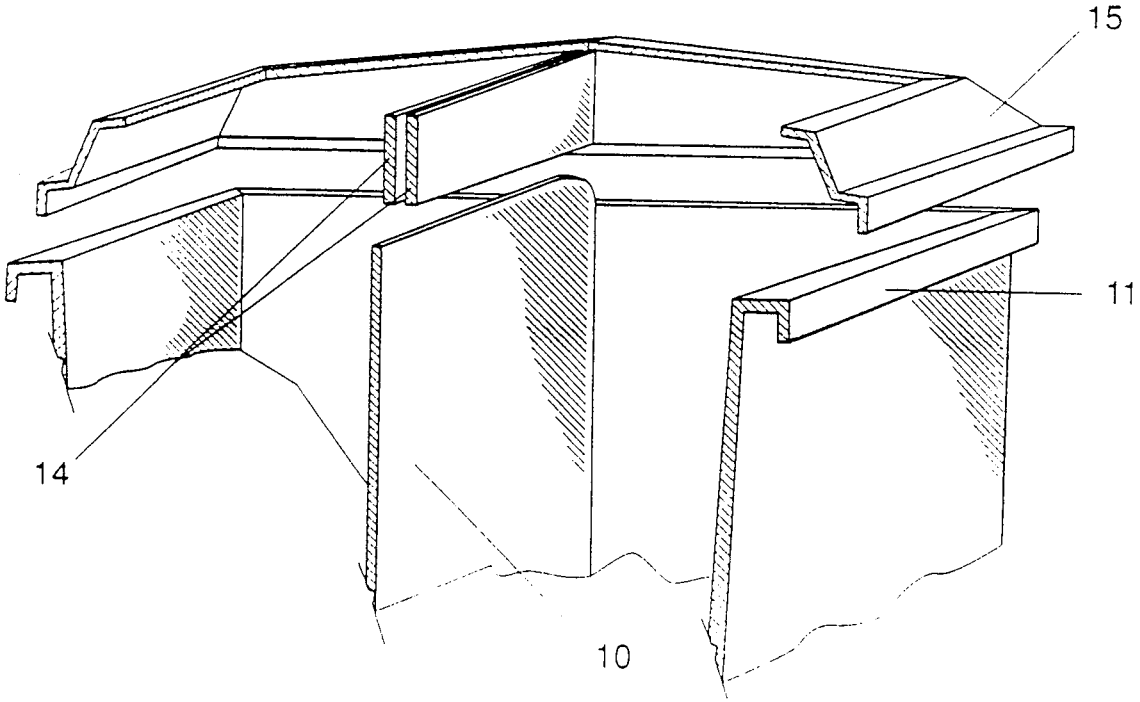
FIG. 10 is an exploded fragmentary view of a frame having two integrally molded parallel members and a partitioned container.

Illustrated in FIG. 9 is a rim-engaging frame 13 having an integrally molded inverted U-member 12 whereby secure support is provided around most of the bags' upper portions. A similar design is disclosed in FIG. 10 where two horizontal parallel members 14 molded to a frame 15. The facing surfaces of the members 14 embrace upper portions of partitions 3 or 10 and inner surfaces of a shelf and lip embrace the rim surfaces of receptacles 1 or 9 respectively, with liner bags 6 and/or 7 frictionally held therebetween.

Figure 11:
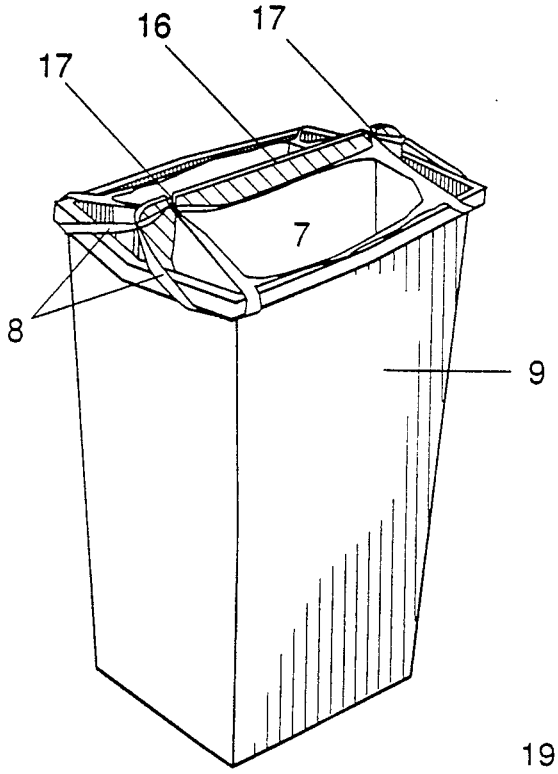
FIG. 11 is a perspective view of a container having a notched partition.

FIG. 11 shows a receptacle 9 having a partition 16 which includes a plurality of notches 17 for an increased degree of convenience and security insofar as positioning and attaching bag handles 8 of bags 7 is concerned.

Figure 12:
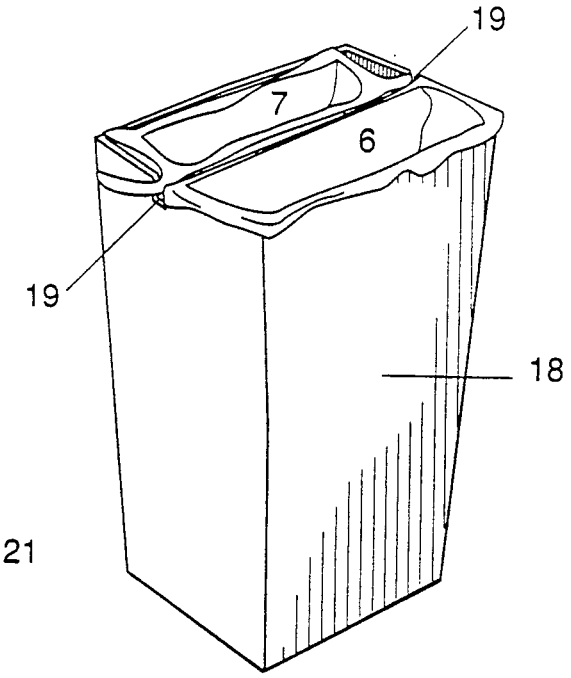
FIG. 12 is a perspective view of a container having bag positioning notches.

In FIG. 12 a non-partitioned container 18 having a plurality of positioning notches 19 is shown including bags 6 and 7 properly positioned and ready to receive a frictionally engaging frame or closure previously described in detail. Additionally, partitions may be included as desired.

Figure 13:
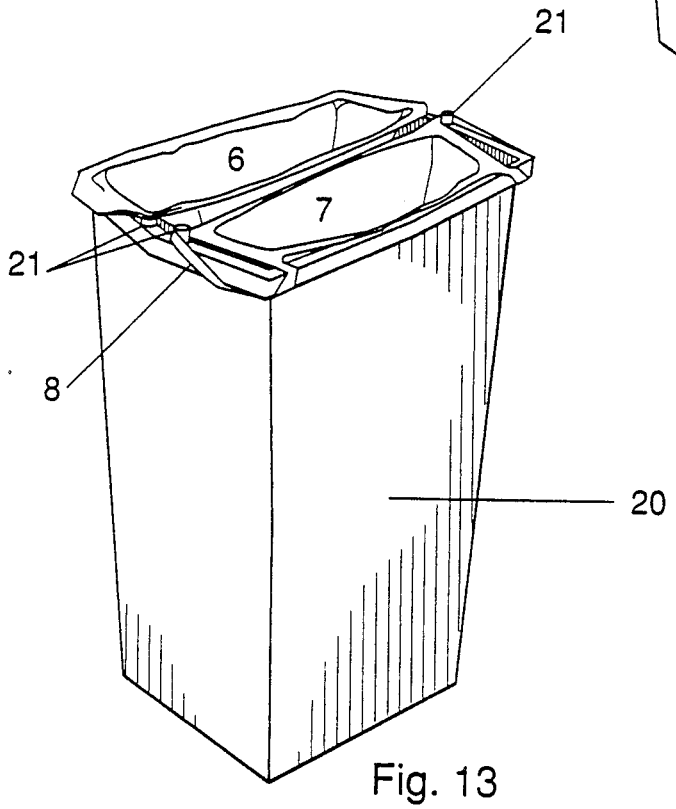
FIG. 13 is a perspective view of a receptacle having bag positioning protrusions.

FIG. 13 shows a non-partitioned container 20 having a plurality of protrusions 21 which are preferably dimensioned so as not to puncture bags 6, which causes them to rip and tear, but are instead sized and dimensioned to merely position them with final support supplied by a frictional engagement frame. Bag 7's handle portion 8 can be positioned as shown or if more protrusions 21 are provided, which can be differently configured, as, for example, mushroom shaped, support can be provided by them entirely. Preferably, frames such as those that were previously described provide final secure support and container 20 of course may include partitions.

Figure 14:
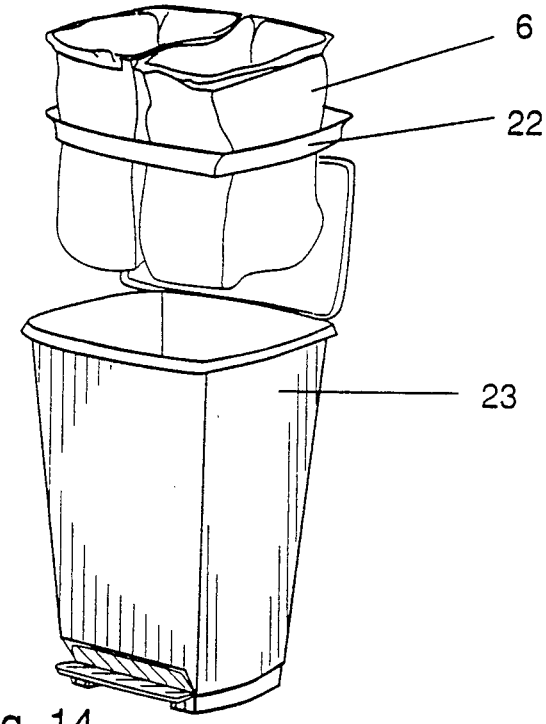
FIG. 14 is an exploded perspective view of a container and frictionally engaging inner frame.
Figure 15:
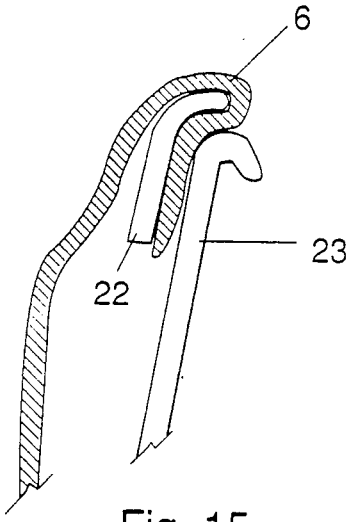
FIG. 15 is a cross sectional view of an inner frame supported by a container's upper edge with a bag portion therebetween.

In FIG. 14 a multiple liner bag support structure is disclosed in the form of an frictionally engaging inner frame 22 that serves to provide support of bags 6 when used in conjunction with a container 23. This is accomplished when the upper edge portions of bags 6 are folded over frame 22 which is dimensioned to fit closely within an inner surface of an upper rim of container 23 with the upper edge portions of bags 6 sandwiched tightly therebetween, as shown best in the cross sectional view of FIG. 15.

Figure 16:
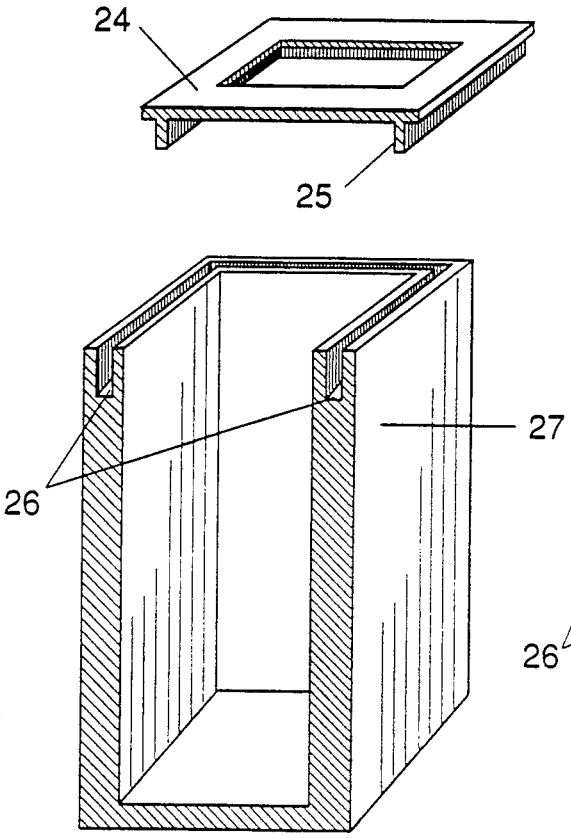
FIG. 16 is an exploded cross sectional perspective view of a container having a groove along its upper portion and a frame having a tongue at its lower edge.
Figure 17:
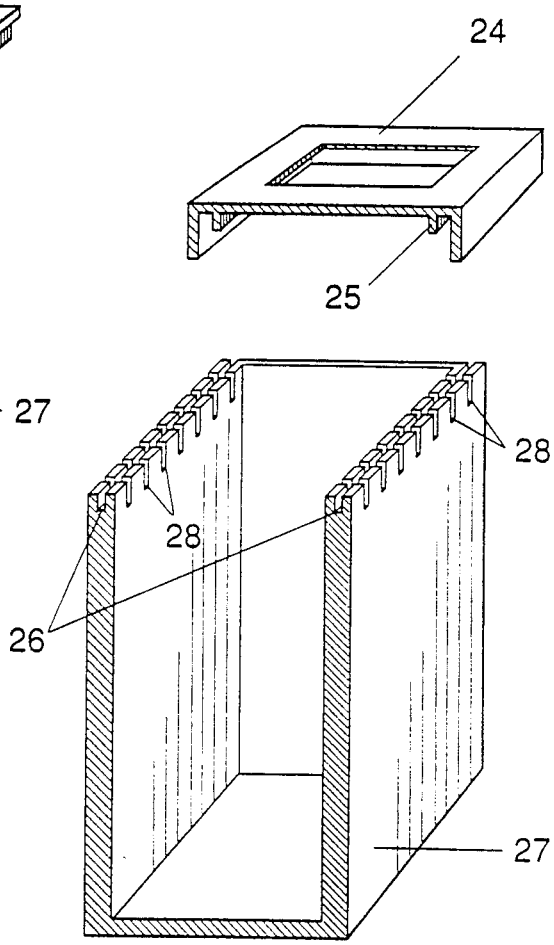
FIG. 17 is an exploded cross sectional perspective view of a container having notches and grooves along its upper portion and a frame having a tongue at its lower edge.

FIG. 16 discloses a multiple liner bag support structure in which a frame 24 is T shaped in cross-section, a tongue 25 constituting the stem of the T, fitting into a groove 26 formed in and around the upper edge of a container 27. In this illustrative embodiment, the tongue 25 and groove 26 extend around all four sides of the rectangular container, one side being sectioned off in the drawing. Bags are positioned according to the user's desire by draping upper edges over container 27 side walls, thus having grooves 26 underneath and being in a position to be securely supported by tongue 25 when inserted into groove 26 with the upper edges of bags 6 therebetween. The elements of FIG. 17 are identical in function and use except that there is provided a plurality of notches 28 which serve to position bags 6 and 7 more conveniently. Additionally, the tongue and groove arrangement can be reversed with the receptacle having the tongue and the frame or closure having the groove. A partition can be used in these embodiments as well, either provided with a groove or tongue, as the case may be, with a complementary cross-piece on the frame, or not.

It is apparent from the foregoing discussion that the present invention provides a more convenient, economical method for people in all facets of our society to participate in recycling efforts which will greatly increase the quantities of recovered recyclables, therefore conserving our natural resources while reducing pollution from other methods of disposal. Thus, the container of this invention is not only simple, reliable and economical, but more importantly, has positive environmental ramifications for this and future generations.

While my above description contains many specificities, these should not be construed as limitations on the scope of the invention, but rather as an exemplification thereof. Many variations are possible.

For example, the herein described structures could be manufactured in a collapsible form or a nestable form to reduce shipping and storage cost. The positioning protrusions can be horizontal, in the form of cleats, more or less, rather than vertical bollards. The partitions and protrusions may be separately attached or integrally molded with the base container. A plurality of partitions can be provided to subdivide the container into a multiplicity of receptacles for a multiplicity of bags. Channels in side walls of the container can accommodate partitions, or notches in the rim can receive tabs projecting laterally from the upper part of a partition, for example. The frictionally engaging closures or frames may be constructed with a combination of both inner and outer frictional engagement means, and various combinations of this application and the subject matter disclosed in my co-pending application will occur to those skilled in the art in the light of the disclosure of the two applications.

Also, the herein described frames and the frictional support they provide may be provided instead by closures with designated apertures and/or swing top lids described in detail in my co-pending application.

All structures herein described are preferably molded from a plastic resin in any of the conventional methods.

Additionally, the invention is applicable to receptacles of various sizes, shapes, constructions and configurations as well as having various combinations of the herein described elements.

These variations are merely illustrative.

Although the herein described structures can be constructed from any suitable material, it is preferable that whenever possible, recycled material be used because it is extremely important for the success of recycling that secondary markets be expanded.

Accordingly, the scope of the invention should be determined not by the embodiments illustrated, but by the appended claims and their legal equivalents.

What is claimed is:

1. In a waste separation receptacle assembly including a container with an open mouth defined by upper edge surfaces of said container and a plurality of thin-walled plastic bags to be mounted in said container, the improvement comprising means on said container for engaging an upper part of each of said bags including an upper surface of said container at said mouth over which said upper part can be draped, and a partition in said container separating said container into a plurality of opened-mouthed sections, said partition being uniformly flat-sided and extending height-wise above said upper edge surfaces of said container to provide side edges and corners to receive at least a part of said bags around said partition side edges and corners.

2. The assembly of claim 1, including means for clamping said upper part of said bags onto said partition.

3. The assembly of claim 2 wherein the said clamping means are carried by said frame.

4. The assembly of claim 3 wherein the said clamping means are integral with said frame.

5. The assembly of claim 2 wherein said means for clamping comprises a U-shaped channel for embracing a top edge of said partition.

6. The assembly of claim 1 wherein said partition is selectively mountable and demountable.

7. The assembly of claim 1 including a frame dimensioned to fit closely with said upper edge surface of said container to sandwich said upper part of said bags between said frame and said upper edge surface, wherein said container has a depending rim and said frame has a depending lip between which said bag upper part is tightly sandwiched.

8. The assembly of claim 7 wherein at least one of said bags has integral looped handles, parts of which are sandwiched between said frame and said container.

9. The assembly of claim 7 wherein one of said container and frame has a tongue and the other, a groove dimensioned to receive said tongue, and said bag edge is sandwiched tightly between said tongue and said groove.

10. The assembly of claim 9 wherein the container has a series of slots opening upwardly through at least one upper edge thereof.

11. The assembly of claim 7 wherein said frame includes a channel aligned with the upper edge of said partition, said channel receiving the upper edge of said partition and an upper surface of said bags disposed over said partition.

12. The assembly of claim 1 wherein at least one of said bags has integral looped handles, and said partition has in an upper edge closer to side edges thereof than to the center line thereof slots to receive parts of said handles.

13. In a waste separation receptacle assembly including a container with a generally rectangular open mouth defined by upper edge surfaces of said container and a plurality of thin-walled plastic bags to be mounted in said container, the improvement comprising a channel opening upwardly through and along at least two upper edge surfaces of said side wall, said channels being defined by two parallel walls; a multiplicity of slots opening upwardly in said parallel channel walls, said slots in facing parallel walls being aligned with their counterparts, and a frame with a peripheral, downwardly projecting tongue dimensioned and configured to be received in said channel between said parallel walls, whereby parts of bags can be received in said channels and sandwiched between said parallel walls and said tongue when said frame is mounted.

* * * * *